US009840871B2

(12) United States Patent
Breckenridge et al.

(10) Patent No.: US 9,840,871 B2
(45) Date of Patent: Dec. 12, 2017

(54) DOWNHOLE MUD MOTOR

(71) Applicant: Rubber Specialists Land Acquisition, LLC, Houston, TX (US)

(72) Inventors: John Steele Breckenridge, Houston, TX (US); Thomas Franklin Akers, II, Spring, TX (US)

(73) Assignee: Rubber Specialists Land Acquisition, LLC, Houston, TX (US)

( * ) Notice: Subject to any disclaimer, the term of this patent is extended or adjusted under 35 U.S.C. 154(b) by 200 days.

(21) Appl. No.: 14/669,276

(22) Filed: Mar. 26, 2015

(65) Prior Publication Data

US 2016/0160565 A1 Jun. 9, 2016

Related U.S. Application Data

(60) Provisional application No. 62/088,935, filed on Dec. 8, 2014.

(51) Int. Cl.

| | |
|---|---|
| ***E21B 4/02*** | (2006.01) |
| ***E21B 7/06*** | (2006.01) |
| ***F03B 13/02*** | (2006.01) |

(52) U.S. Cl.

CPC ..... *E21B 4/02* (2013.01); *E21B 7/067* (2013.01); *E21B 7/068* (2013.01); *F03B 13/02* (2013.01)

(58) Field of Classification Search

CPC . F03B 13/02; E21B 4/02; E21B 7/067; E21B 7/068

USPC ..... 175/107

See application file for complete search history.

(56) References Cited

U.S. PATENT DOCUMENTS

| | | | | |
|---|---|---|---|---|
| 3,840,080 | A * | 10/1974 | Berryman | E21B 4/02 175/107 |
| 4,823,889 | A * | 4/1989 | Baldenko | F04C 15/06 175/107 |
| 9,016,401 | B2 * | 4/2015 | Savage | E21B 47/02 175/61 |
| 9,328,576 | B2 * | 5/2016 | Cramer | E21B 34/10 |
| 9,435,187 | B2 * | 9/2016 | Hohl | E21B 41/00 |
| 9,523,251 | B2 * | 12/2016 | Honekamp | E21B 23/04 |
| 9,556,677 | B2 * | 1/2017 | Smith | E21B 7/067 |
| 2007/0068705 | A1 * | 3/2007 | Hosie | E21B 4/02 175/57 |

(Continued)

*Primary Examiner* — David J Bagnell
*Assistant Examiner* — Nikhil Menon
(74) *Attorney, Agent, or Firm* — Jackson Walker L.L.P.

(57) ABSTRACT

A disclosed mud motor includes a rotor head, a motor block, a hollow rotor, an inlet shaft, and an outlet shaft. In the operation of one embodiment, a pressurized drilling mud enters the rotor head through the inlet shaft. Some or all of the drilling mud is directed through an included inlet passage onto pistons which are included in the motor block and disposed concentrically around the outlet shaft. A downward action of the pistons resulting from the drilling mud causes an included power plate to rotate. Rotation of the power plate causes the hollow rotor and the rotor head to also rotate. The hollow rotor may be attached to a drilling implement. Rotation of the power plate also causes some or all of the drilling mud directed onto the pistons to be discharged into the outlet shaft through an included discharge passage. During the operation of one embodiment of the mud motor, the pistons do not rotate around the outlet shaft, but instead remain substantially in their original concentric alignment.

14 Claims, 2 Drawing Sheets

(56) References Cited

U.S. PATENT DOCUMENTS

2010/0038142 A1* 2/2010 Snyder ..... E21B 4/02
175/107

* cited by examiner

DOWNHOLE MUD MOTOR

CROSS REFERENCE TO RELATED APPLICATIONS

This application claims priority from U.S. Provisional Patent Application No. 62/088,935, filed on Dec. 8, 2014, entitled "DOWNHOLE MUD MOTOR", which is incorporated by reference herein. An application data sheet containing this priority claim is submitted herewith.

BACKGROUND

Field of the Disclosure

The present disclosure relates to downhole drilling operations and, more particularly, to a mud motor for downhole drilling.

Description of the Related Art

Columns or strings of pipe referred to as drill strings are used to transmit drilling fluid and torque to a drill bit used to drill a well hole. Drill strings are hollow so that drilling fluid may be pumped down through the drill string and circulated back to the top, including by way of the void that is between the outer casing of the drill string and the hole in which the drill string is inserted. Mud motors (also referred to as drilling motors) may be included in the drill string and may be used to provide additional rotational power to the drill bit while drilling.

DESCRIPTION OF EXEMPLARY EMBODIMENTS

Figure 1:
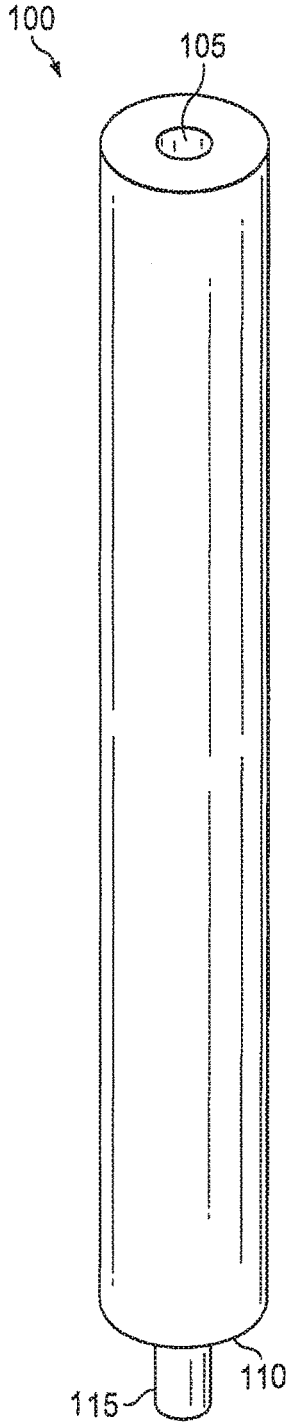
FIG. 1 is an image showing selected elements of an embodiment of a mud motor.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Disclosed herein is a mud motor. In one embodiment, the mud motor includes a rotor head, a motor block, a hollow rotor, an inlet shaft, and an outlet shaft. In the operation of one embodiment, a pressurized drilling mud enters the rotor head through the inlet shaft and is directed through an inlet passage in the rotor head into the motor block. In at least one embodiment, the motor block includes a plurality of pistons axially aligned within cylinder bores concentrically disposed around the outlet shaft and the outlet shaft is substantially centrally positioned within the mud motor. A power plate is located below the pistons in at least one embodiment and the power plate has a centrally located circular opening configured to encompass the outlet shaft, encompasses the outlet shaft with an inclined orientation thereto, and is configured to rotate around the outlet shaft and within the motor block. In at least one embodiment, the motor block includes the power plate and the power plate rotates within the motor block.

In at least one embodiment, the outlet shaft vertically extends from the bottom of the rotor head to the bottom of the mud motor and passes through the circular opening of the power plate. In such an embodiment, a hollow rotor that rotates within the outlet shaft is centrally disposed within the outlet shaft and the hollow rotor extends from the rotor head, passes through the motor block and the power plate, and terminates at or below the mud motor. The hollow rotor may be fixedly attached to both the rotor head and the power plate in at least one embodiment. In the operation of at least one embodiment, upon entering the motor block, the drilling mud is directed to sequentially push each of the pistons down upon the angled power plate. The resulting action causes the power plate to rotate. During the rotation of the power plate, the angled orientation of the power plate causes the power plate to sequentially push some or all of the downwardly extended pistons up, thereby expelling some or all of the drilling mud that pushed the pistons down. The drilling mud is expelled from at least one of the pistons by directing it to the hollow rotor through a discharge passage in the rotor head that leads into the hollow rotor. As a result, some or all of the drilling mud that enters the mud motor in such embodiments is discharged from the mud motor through the hollow rotor. The discharge of the drilling mud may occur at the bottom of the mud motor. Because the hollow rotor is fixedly attached to both the power plate and the rotor head, the rotation of the power plate causes the hollow rotor and the rotor head to both rotate as well. The pistons, however, do not rotate around the outlet shaft in such embodiments, but instead substantially remain in their original concentric alignment. In at least one embodiment, the rotation of the rotor head maintains both (i) the timing of the inlet passage in relation to the position of the pistons so that the pressurized drilling mud is sequentially directed through the inlet passage to some or all of the pistons that have been pushed up by the power plate so as to cause the downward stroke of each such piston and (ii) the timing of the discharge passage so that the pressurized drilling mud is directed through the discharge passage out of the motor block and into the hollow rotor from some or all of the pistons during their upward stroke caused by the power plate.

In this way the drilling mud is directed by the rotor head, in at least one embodiment, to sequentially push some or all of the pistons down onto the power plate and the resulting action causes the power plate to rotate and the rotation of the angled power plate sequentially pushes some or all of the downwardly extended or substantially downwardly extended pistons up, with some or all of the drilling mud being directed from the pistons during their upward stroke out of the motor block and into the hollow rotor. The process repeats itself such that the power plate, the hollow rotor, and the rotor head may remain in substantially continuous rotation while the pressurized drilling mud is directed into and out of the motor block. In some embodiments, the end of the hollow rotor may be connected to a drill bit and thereby add to the torque and rotation of the drill bit during the operation of the mud motor.

In one embodiment, a mud motor includes an inlet shaft, a rotor head, a motor block, an outlet shaft, and a power plate. In at least one embodiment, the inlet shaft is disposed at a top end of the mud motor and the motor block includes a plurality of cylinder bores concentrically disposed around the outlet shaft with each cylinder bore including a piston configured to reciprocate within the cylinder bore. In at least one embodiment, the rotor head is rotatably attached at a first end to the inlet shaft and fixedly attached at a second end to a hollow rotor and the rotor head is configured to rotate within the mud motor and to redirect a fluid received via the inlet shaft into and out of the motor block upon rotation. The hollow rotor may, in at least one embodiment, be centrally disposed within the outlet shaft and the outlet shaft may extend from the second end of the rotor head to a bottom end of the mud motor.

In at least one embodiment, the power plate is fixedly attached to the hollow rotor at an angle, disposed at a lower portion of the motor block, and may rotate within the motor block. The attachment of the power plate to the hollow rotor may be accomplished with a timing pin or bolt. The power plate may support a driving end of each of the pistons such that in operation, when a piston is driven against the power plate by the fluid redirected by the rotor head to the motor block, the power plate rotates. In at least one embodiment, the rotation of the power plate in turn causes the hollow rotor affixed to the power plate to rotate which in turn causes the rotor head affixed to the hollow rotor to rotate as well.

In at least one embodiment, the cylinder bores remain substantially stationary with respect to their concentrical alignment around the outlet shaft during operation of the mud motor. In at least one embodiment, the rotor head includes an inlet passage that directs some or all of the fluid into the motor block and a discharge passage that directs the fluid out of the motor block and into the hollow rotor. In at least one embodiment, the inlet passage sequentially directs the fluid received from the inlet passage to some or all of the pistons to cause a downward movement of some or all of the pistons and the discharge passage directs some or all of the fluid ejected by some or all of the pistons to the hollow rotor when the rotation of the power plate pushes some or all of the downwardly extended pistons to a non-extended position such that some or all of the fluid within the corresponding cylinder bores is ejected by the pistons during their upward movement.

In some embodiments, the mud motor includes a motor block, a rotor head, and a power plate. In at least one of these embodiments, the mud motor may include a plurality of cylinder bores concentrically disposed around an outlet shaft and each of the cylinder bores includes a piston configured to reciprocate within the cylinder bore. The rotor head in some of these embodiments may be attached to a hollow rotor, which may be centrally disposed within the mud motor, and the rotor head may be configured to rotate within the mud motor and to redirect a fluid received into the mud motor to and from the motor block upon rotation. The power plate in at least one of these embodiments may support a driving end of each of the pistons and may be fixedly attached at an angle to the hollow rotor and disposed below the motor block. In other of these embodiments, the power plate may support a driving end of at least one of the pistons. In these embodiments, a piston driven against the power plate by the fluid redirected by the rotor head to the motor block may cause the power plate, the hollow rotor, and the rotor head to rotate and during such operation of the mud motor, the cylinder bores may remain substantially stationary with respect to their concentrical alignment around the outlet shaft. In some of these embodiments, the rotor head includes an inlet passage and the inlet passage directs the fluid to at least one of the pistons. In at least one of these embodiments, the rotor head includes a discharge passage and the discharge passage receives the fluid expelled from at least one of the pistons and directs the expelled fluid to the hollow rotor.

The mud motor may, in some embodiments, further include a flow bypass valve or jet. The flow bypass jet may be included within the rotor head and may direct all or a portion of the fluid from the inlet shaft to the hollow rotor so as to bypass the pistons. The flow bypass jet may be adjustable with respect to the amount of fluid that is directed by the flow bypass jet to the hollow rotor and thereby control a rotational speed of the mud motor.

Throughout this disclosure, a hyphenated form of a reference numeral refers to a specific instance of an element and the un-hyphenated form of the reference numeral refers to the element generically or collectively. Thus, widget 12-1 refers to an instance of a widget class, which may be referred to collectively as widgets 12 and any one of which may be referred to generically as a widget 12.

Referring first to FIG. 1, an image showing selected elements of an embodiment of mud motor 100 is depicted. In the depicted embodiment, mud motor 100 includes inlet shaft 105 and hollow rotor 115. Hollow rotor 115, as depicted in more detail in FIG. 2, passes through a lower end 110 of mud motor 100. When in operation, a pressurized fluid, which may be or which may include drilling mud, may enter inlet shaft 105 and, as is depicted in more detail in FIG. 2, may be sequentially directed by rotor head 220 to pistons 225 which, by way of power plate 230, cause hollow rotor 115 and rotor head 220 to both rotate. The pressurized fluid may exit mud motor 100 by way of hollow rotor 115.

Figure 2:
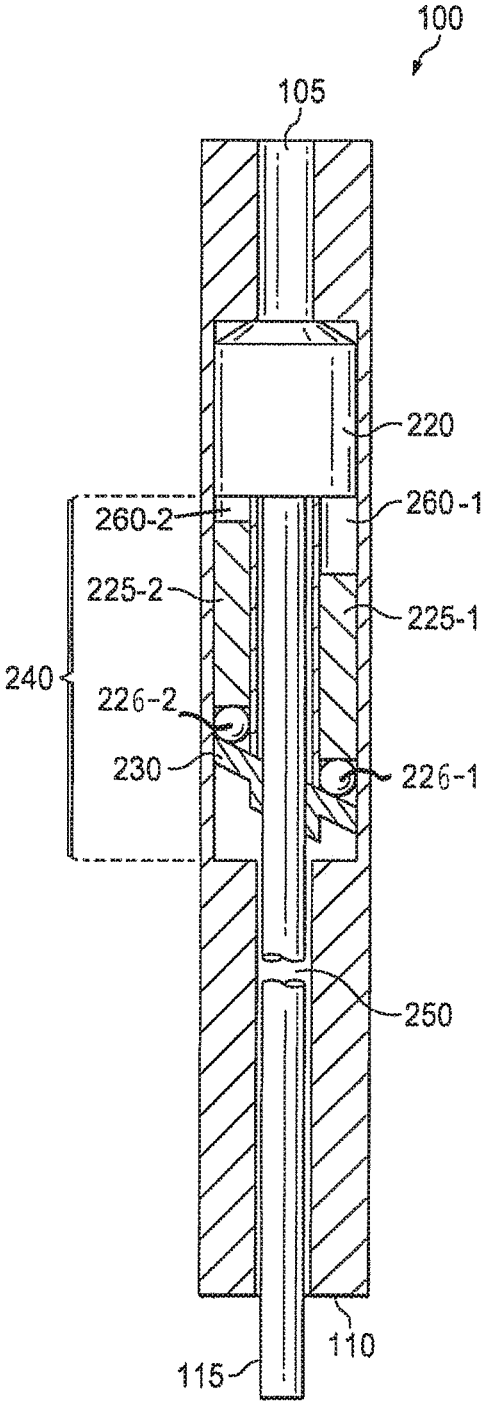
FIG. 2 is a cross-sectional image of the mud motor of FIG. 1.

Turning now to FIG. 2, an image showing selected elements of an embodiment of mud motor 100 is depicted. In the depicted embodiment, mud motor 100 includes inlet shaft 105, rotor head 220, motor block 240, and outlet shaft 250. In one embodiment, rotor head 220 may be rotatably coupled to inlet shaft 105 at one end of rotor head 220 and may be fixedly coupled to hollow rotor 115 at an opposite end of rotor head 220 such that rotor head 220 rotates about inlet shaft 105.

In the depicted embodiment, motor block 240 includes a plurality of pistons 225, a plurality of cylinder bores 260, and power plate 230. In the depicted embodiment, rotor head 220 is adjacent to motor block 240 and axially aligned with pistons 225, and pistons 225 are disposed concentrically around outlet shaft 250. In one embodiment, pistons 225 are disposed concentrically around outlet shaft 250 within cylinder bores 260 and fixedly attached within motor block 240 so that pistons 225 move in an upward and downward manner within their respective cylinder bores, but do not revolve in a rotational direction about outlet shaft 250 during operation of mud motor 100. In one embodiment, mud motor 100 includes six of pistons 225 disposed concentrically around outlet shaft 250.

Pistons 225, in the depicted embodiment, include driving ends 226 which are configured to slidably engage with the upper face of power plate 230. In one embodiment, power plate 230 has a centrally located circular opening and is configured to rotate inside outlet shaft 250, and outlet shaft 250 vertically extends from the bottom of rotor head 220 to a bottom end 110 of mud motor 100 and is configured to receive power plate 230. Hollow rotor 115 is centrally disposed within outlet shaft 250 in the depicted embodiment and may extend from rotor head 220, pass through motor block 240 and the opening of power plate 230, and terminate at, below, or near bottom end 110 of mud motor 100. In at least one embodiment, hollow rotor 115 is fixedly attached to both rotor head 220 and power plate 230 such that the rotation of power plate 230 causes a corresponding rotation of hollow rotor 115 and rotor head 220.

Figure 3:
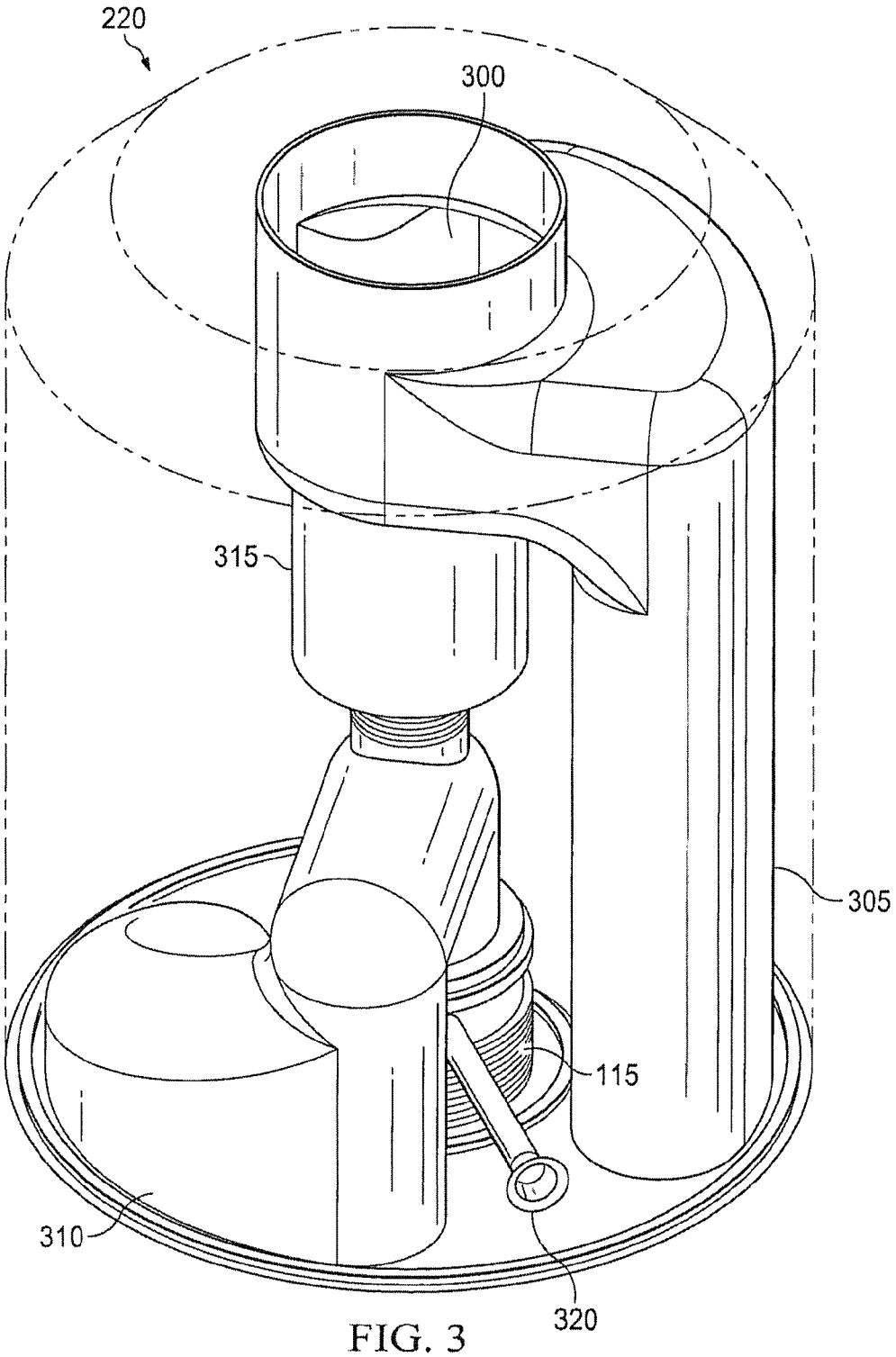
FIG. 3 is an image showing further detail of the mud motor of FIG. 1.

Turning now to FIG. 3, selected elements of rotor head 220 are illustrated. Rotor head 220 may include inlet passage 305, discharge passage 310, and flow bypass jet or valve 315. In the depicted embodiment, inlet passage 305 is configured to receive inlet shaft 105 at inlet passage port 300 and further configured to direct pressurized fluid received via inlet shaft 105 via inlet passage port 300 into motor block 240 and onto some or all of pistons 225 when pistons 225 are at their substantially upward or non-extended position (or have reached their apex of travel upward by the rotation of power plate 230). In the depicted embodiment, the base of inlet passage 305 is exposed to a plurality of pistons 225 that are adjacent to one another. In at least one embodiment, the base of inlet passage 305 is exposed to half of the total number of concentrically disposed pistons 225 with some or all of such pistons 225 to which the base of inlet passage 305 is exposed occupying a position within their respective cylinder bores 260 which is just after apex of travel to just before base of travel for pistons 225. In the depicted embodiment, discharge passage 310 is exposed to a plurality of pistons 225 that are adjacent to one another and is configured to direct some or all of the fluid that is expelled from pistons 225 during their upward travel to hollow rotor 115. As depicted in FIG. 2, it will be appreciated that while all of pistons 225 will, at some time during the operation of mud motor 100, be exposed to both inlet passage 305 and discharge passage 310, such exposure will occur in a sequential, not simultaneous manner. In other embodiments, at least one of pistons 225 may be exposed simultaneously to both inlet passage 305 and discharge passage 310 during the operation of mud motor 100.

In a preferred embodiment, inlet passage port 300 is rotatably attached to inlet shaft 105, and inlet passage 305 and discharge passage 310 are both rigidly attached to hollow rotor 115. A pin or bolt may be inserted into timing passage 320 and may serve to fixedly secure the position of rotor head 220 with hollow rotor 115 and thereby align and maintain the position of inlet passage 305 and discharge passage 310 over pistons 225 so as to ensure the pressurized fluid is directed to pistons 225 in a sequential manner via inlet passage 305 when pistons 225 are substantially at their upward travel position. A similar pin or bolt may be configured to fixedly attach power plate 230 to hollow rotor 115 and thereby align and maintain the position of power plate 230 to pistons 225.

In the operation of an embodiment of mud motor 100, pressurized fluid is introduced into rotor head 220 at inlet passage port 300 through inlet shaft 105. Rotor head 220 directs some or all of the pressurized fluid by way of inlet passage 305 onto pistons 225. Some or all of pistons 225 are consequently pushed downward within their respective cylinder bores 260. The resulting reaction force of pistons 225 pushing down on power plate 230 in such embodiment causes power plate 230 to revolve in a rotational direction within motor block 240 and outlet shaft 250. In concert with this action, hollow rotor 115, which is fixedly attached to power plate 230 in such embodiment, rotates within outlet shaft 250 and in turn causes rotor head 220, which is fixedly attached to hollow rotor 115, to rotate. As power plate 230 rotates in such embodiment, its angular position causes pistons 225 that are in a downwardly extended position to be sequentially pushed upward. As pistons 225 are pushed upward in such embodiment, some or all of the pressurized fluid in the corresponding cylinder bores 260 exits rotor head 220 through discharge passage 310 and is ejected into hollow rotor 115 by way of discharge passage 310. As rotor head 220 rotates in such embodiment, inlet passage 305 and discharge passage 310 direct some or all of the pressurized fluid to enter into and be discharged from cylinder bores 260 for some or all of pistons 225 such that for every half revolution of power plate 230, at least some of pistons 225 change from a downward direction to an upward direction. Thus, while pistons 225 remain in a substantially fixed position in such embodiment with respect to their concentric location about outlet shaft 250, power plate 230, hollow rotor 115, and rotor head 220 rotate when pressurized fluid is introduced into motor block 240.

In one embodiment, rotor head 220 includes bypass jet 315 which may selectively direct some or all of the pressurized fluid from inlet passage 305 to hollow rotor 115 so that some or all of the pressurized fluid bypasses pistons 225. In this manner, the speed or number of rotations of power plate 230, hollow rotor 115, and rotor head 220 may be selectively controlled.

To the maximum extent allowed by law, the scope of the present disclosure is to be determined by the broadest permissible interpretation of the following claims and their equivalents, and shall not be restricted or limited to the specific embodiments described in the foregoing detailed description.

What is claimed is:

1. A mud motor, comprising:

an inlet shaft disposed at a top end of the mud motor;

an outlet shaft;

a motor block, including a plurality of cylinder bores concentrically disposed around the outlet shaft, wherein each of the cylinder bores includes a piston configured to reciprocate within the cylinder bore;

a rotor head rotatably attached at a first end to the inlet shaft and fixedly attached at a second end to a hollow rotor, wherein the rotor head is configured to rotate within the mud motor and to redirect an external fluid stream received via the inlet shaft to and from the motor block upon rotation, wherein the hollow rotor is centrally disposed within the outlet shaft, and further wherein the outlet shaft extends vertically from the second end of the rotor head to a bottom end of the mud motor; and a power plate fixedly attached to the hollow rotor at an angle and disposed below the motor block, wherein the power plate supports a driving end of each of the pistons;

wherein the fluid redirected by the rotor head to the motor block enters the cylinder bores and drives the pistons against the power plate causing the power plate, the hollow rotor, and the rotor head to rotate; and further wherein, the cylinder bores remain stationary with respect to their concentrical alignment around the outlet shaft during operation of the mud motor.

2. The mud motor of claim 1 wherein the rotor head includes:

an inlet passage, wherein the inlet passage directs the fluid to the pistons.

3. The mud motor of claim 2 wherein the inlet passage sequentially directs the fluid received from the inlet shaft to the pistons.

4. The mud motor of claim 1 wherein the rotor head includes:

a discharge passage, wherein the discharge passage directs the fluid expelled by the pistons to the hollow rotor.

5. The mud motor of claim 4 wherein the discharge passage sequentially receives the fluid expelled from at least one of the pistons and directs the expelled fluid to the hollow rotor.

6. The mud motor of claim 1, further comprising:

a flow bypass jet, wherein the flow bypass jet directs a portion of the fluid from the inlet shaft to the hollow rotor so as to bypass the pistons.

7. The mud motor of claim 6, wherein the flow bypass jet is adjustable to control a rotational speed of the mud motor.

8. A mud motor, comprising:

a motor block, including a plurality of cylinder bores concentrically disposed around an outlet shaft, wherein each of the cylinder bores includes a piston configured to reciprocate within the cylinder bore;

a rotor head attached to a hollow rotor, wherein the rotor head is configured to rotate within the mud motor and to redirect a fluid stream received from an external source into the mud motor to and from the motor block upon rotation, wherein the hollow rotor is centrally disposed within the mud motor; and a power plate fixedly attached at an angle to the hollow rotor and disposed below the motor block, wherein the power plate supports a driving end of each of the pistons;

wherein the pistons when driven against the power plate by the fluid stream redirected by the rotor head to the motor block cause the power plate, the hollow rotor, and the rotor head to rotate; and further wherein the cylinder bores remain stationary with respect to their concentrical alignment around the outlet shaft during operation of the mud motor.

9. The mud motor of claim 8 wherein the rotor head includes an inlet passage.

10. The mud motor of claim 9 wherein the inlet passage directs the fluid to at least one of the pistons.

11. The mud motor of claim 8 wherein the rotor head includes a discharge passage.

12. The mud motor of claim 11 wherein the discharge passage receives the fluid expelled from at least one of the pistons and directs the expelled fluid to the hollow rotor.

13. The mud motor of claim 8, further comprising:

a flow bypass jet, wherein the flow bypass jet directs a portion of the fluid from the inlet shaft to the hollow rotor so as to bypass the pistons.

14. The mud motor of claim 13 wherein the flow bypass jet is adjustable to control a rotational speed of the mud motor.

* * * * *